US005727488A

United States Patent [19]

Moll

[11] Patent Number: 5,727,488

[45] Date of Patent: Mar. 17, 1998

[54] DEVICE FOR HOLDING WORKPIECES FOR MACHINING OPERATIONS, ESPECIALLY FOR SEWING

[75] Inventor: Philip Moll, Aachen, Germany

[73] Assignee: Altin-Nähtechnik GmbH, Altenburg, Germany

[21] Appl. No.: 666,580

[22] PCT Filed: May 22, 1995

[86] PCT No.: PCT/EP95/01927

§ 371 Date: Jul. 2, 1996

§ 102(e) Date: Jul. 2, 1996

[87] PCT Pub. No.: WO95/33879

PCT Pub. Date: Dec. 14, 1995

[30] Foreign Application Priority Data

Jun. 4, 1994 [DE] Germany ..... 44 19 700.4

[51] Int. Cl.[6] ..... D05B 39/00; B25B 5/14

[52] U.S. Cl. ..... 112/470.14; 112/475.12; 269/54.1

[58] Field of Search ..... 112/470.14, 470.12, 112/470.13, 114, 311, 470.06, 470.07, 475.07, 63, DIG. 2, DIG. 3, 475.12; 294/61; 271/18.3; 901/31, 37, 39; 269/54.1, 54.4, 54.5

[56] References Cited

U.S. PATENT DOCUMENTS

| | | | |
|---|---|---|---|
| 3,386,763 | 6/1968 | Ottaway et al. | 271/18.3 X |
| 4,094,260 | 6/1978 | Kleinschmidt et al. | 112/470.14 |
| 4,220,104 | 9/1980 | Humphreys | 112/475.12 |
| 4,524,705 | 6/1985 | Humphreys . | |
| 4,622,909 | 11/1986 | Vinicio . | |
| 4,688,837 | 8/1987 | Ball et al. | 294/61 |
| 4,989,525 | 2/1991 | Portilla | 112/63 X |
| 5,509,367 | 4/1996 | Conley, Jr. | 112/103 X |

FOREIGN PATENT DOCUMENTS

| | | | |
|---|---|---|---|
| 0 344 400 A1 | 6/1988 | European Pat. Off. . | |
| 2 374 862 | 7/1978 | France . | |
| 1 660 811 | 5/1971 | Germany . | |
| 69 07 434 | 9/1971 | Germany . | |
| 28 37 544 B2 | 6/1980 | Germany . | |
| 8310847 U | 11/1983 | Germany . | |
| 29 03 473 C2 | 6/1985 | Germany . | |
| WO 92/13986 | 8/1992 | WIPO . | |
| WO 93/04228 | 3/1993 | WIPO | 112/470.12 X |

*Primary Examiner*—Peter Nerbun
*Attorney, Agent, or Firm*—McGlew and Tuttle

[57] ABSTRACT

The present invention pertains to a device for producing three-dimensional casings, which, for holding blanks that are preferably made of materials having a low bending strength, has a carrier body, on which the blank can be mounted in a detachable manner, wherein the carrier body has at least one holding unit with a holding element, whose contact area can be transferred from a resting position situated within the carrier body into a contact position situated outside the carrier body.

16 Claims, 3 Drawing Sheets

DEVICE FOR HOLDING WORKPIECES FOR MACHINING OPERATIONS, ESPECIALLY FOR SEWING

FIELD OF THE INVENTION

The present invention pertains to a device for holding at least one blank or workpiece, made of a material preferably having a low bending strength, in a predetermined position during a machining operation, especially during a sewing operation, for the production of a three-dimensional casing. The device has a carrier body, which is provided with at least one contact surface and essentially corresponds to the shape of the casing to be produced. The blank can be mounted on the contact surface in a detachable manner, and the device is provided with at least one holding unit, which holds the blank on the contact surface during the machining operation.

BACKGROUND OF THE INVENTION

In order to machine blanks made of a material having low bending strength into three-dimensional casings with automated production devices, it is possible to mount the blanks on a carrier body, which essentially has the shape of the casing to be produced. In this case, the blanks are arranged at an angle to one another such that their edge areas at least partially overlap. Subsequently, a suitable tool, e.g., a sewing machine arranged on an arm of a manipulator, moves along the overlapping area, by means of which the two blanks are connected. A large field of application exists for this, e.g., the sewing of textile materials or leather. Since the sewing machines of such automated sewing systems move along predetermined paths, it is necessary for the blanks to be arranged exactly at the positions provided for this during the sewing operation.

However, based on the low-bending-strength properties of these materials, it has proved to be difficult to achieve and maintain this positioning for the duration of the machining operation. Therefore, corresponding devices exist in the state of the art in order to guarantee this maintaining of position. Thus, each feeding device is fitted with a blank and together with this blank is arranged on a carrier body in a device that has become known from German Patent DE-PS 42 25 008. After the feeding device has been removed again, its holding plates remain on the blank. The metallic holding plates then press the blank, which is located between them and the carrier body, onto the corresponding contact surface of the carrier body by means of a magnet of same. In order to hold the blank securely, the pressing surfaces of the holding plates are only slightly smaller than the blank, so that the edge zone of this blank to be machined protrudes against these pressing surfaces. Since the holding plates also lie on the side of the blank opposite the carrier body during the sewing, the blank is not readily accessible. The movement of the sewing arm of a sewing machine must therefore be adapted to the arrangement of the holding plate, which, above all, is felt to be a disadvantage if the blank is to be, e.g., also embroidered. It is likewise not satisfactory that the holding plates must be removed again after the sewing operation and be fed again to the carrier body after the casing has been removed from same. In addition, the fixing of the blanks by means of holding plates leads to the fact that the feeding device, since it must accommodate a holding plate in addition to the particular blank, is structurally relatively complicated. Furthermore, this manner of fixing the blanks is relatively time-consuming, since the holding plates must be handled outside of the actual sewing operation, whereby the time needed for a machining cycle of a casing is relatively long.

SUMMARY AND OBJECTS OF THE INVENTION

The object of the present invention is to provide a device of the type described in the introduction, by means of which a blank or workpiece can be held securely during a machining operation, without having the described disadvantages.

This object is attained with a device where each holding unit has holding elements arranged in a recess of the carrier body. These holding elements can be transferred from a resting position situated within the carrier body to a contact position, in which their contact sections are located outside the carrier body.

In a preferred embodiment, the holding elements are each able to be acted upon by a pressure medium and are provided with a spring element. To achieve an especially rapid transfer of the holding elements into the contact position, it is thus advantageous that the holding element transfers to the resting position by means of being acted upon by a pressure medium, and it also remains there for the duration of the pressurization. It is thereby guaranteed that the stay of the holding elements in the contact position is independent of a possible drop in pressure.

A further advantage of this embodiment of the present invention is that energy must only be supplied for the transfer of the holding elements from the contact position into the resting position, and the holding elements remain in the working position by means of the action of the spring elements. However, in other embodiments of the present invention, the holding elements may be designed such that they are moved into the final positions, e.g., by means of electric or magnetic energy.

Moreover, the holding elements are preferably able to be transferred from the resting position into the contact position by means of a movement, which is essentially parallel to their longitudinal axis. This likewise contributes to a simple structural design, since, in this case, the recesses may be produced by cylindrical holes, on the one hand, and rectilinear movements can be carried out in a structurally relatively simple manner, on the other hand.

In another preferred embodiment of the present invention, it is possible for the holding elements to have needles, wherein the contact sections are formed by their tips. Thus, especially flexible materials are able to be fixed securely. Moreover, in the case of these types of materials, needles have the advantage that they exhibit only very little wear, and thus, longer service lives are possible.

In order to fix, e.g., leather or foil blanks during a machining operation while avoiding damage caused by needle punctures, it may be advantageous for the holding units either to have a suction device that generates a vacuum or to be provided with a push rod, which brings an adhesive tape, which is to be moved by it, into contact with the blank. Embodiments of the present invention, in which combinations of suction device, push rod with adhesive tape and/or needles may be provided as holding elements, are, of course, also possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
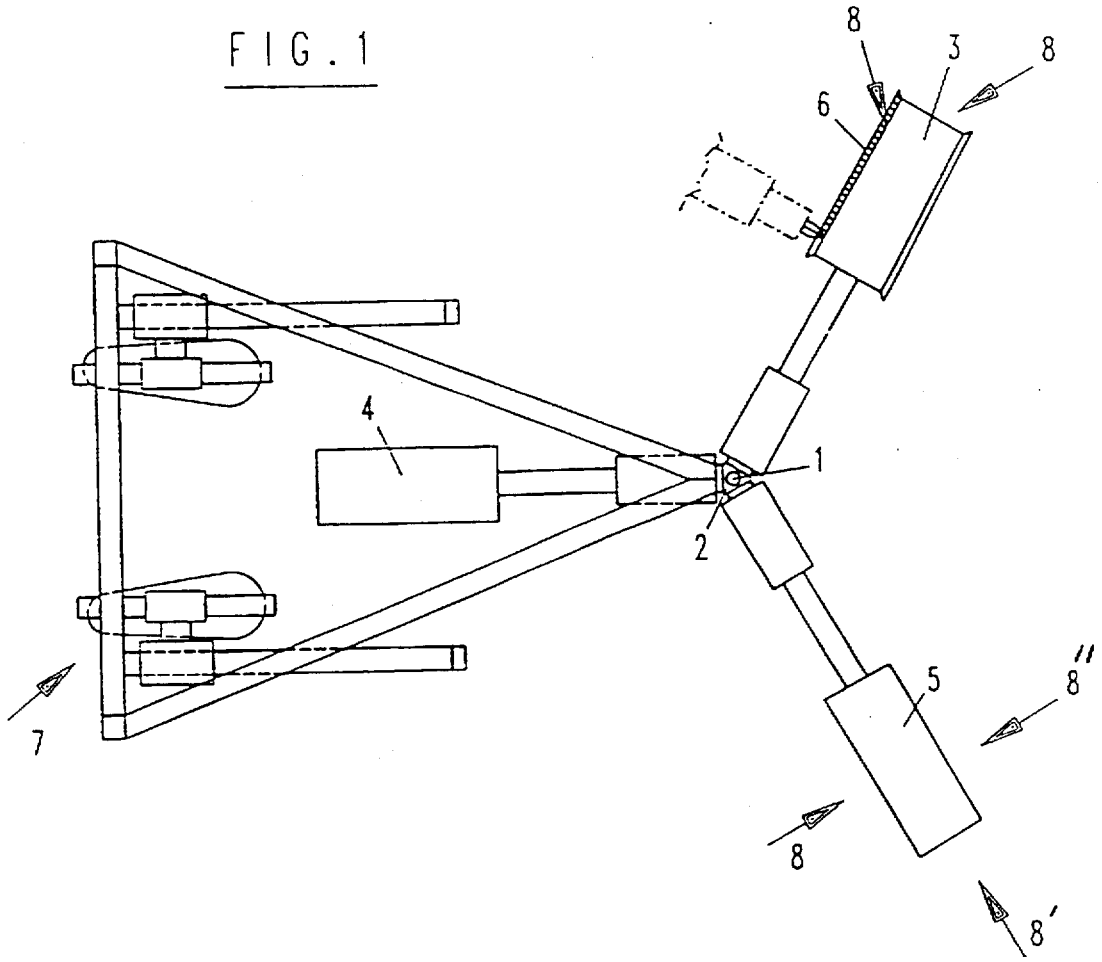
FIG. 1 is a top view of a device integrated into a sewing system.

Referring to the drawings, the present invention includes a device for holding workpieces, e.g., blanks made of materials preferably having low bending strength that are used to produce three-dimensional casings. The device is integrated into an automated sewing system and is arranged on an arm mount 2 that is rotatable about an axis 1 in the clockwise direction, as shown in FIG. 1 to illustrate a possible application of the present invention. The device has three carrier bodies 3, 4 and 5. The outer shape of the carrier bodies substantially or essentially corresponds to the shape that the finished casings are to have. A sewing system to be used in this context is described in detail in DE-PS 42 25 008, as mentioned in the introduction.

In FIG. 1, the carrier body 3 is in a position, in which it is already fitted with blanks 6. This position is the sewing position. The carrier body 4, which has yet to be fitted with blanks, is in a fitting position and will be fitted there by means of a feeding device 7. In contrast, the carrier body 5 is positioned such that the blanks, which have already been sewn together, are able to be removed from it. All the carrier bodies 3, 4, 5 are provided for holding the blanks 6 each with one or more contact surfaces 8, 8', 8".

Figure 2:
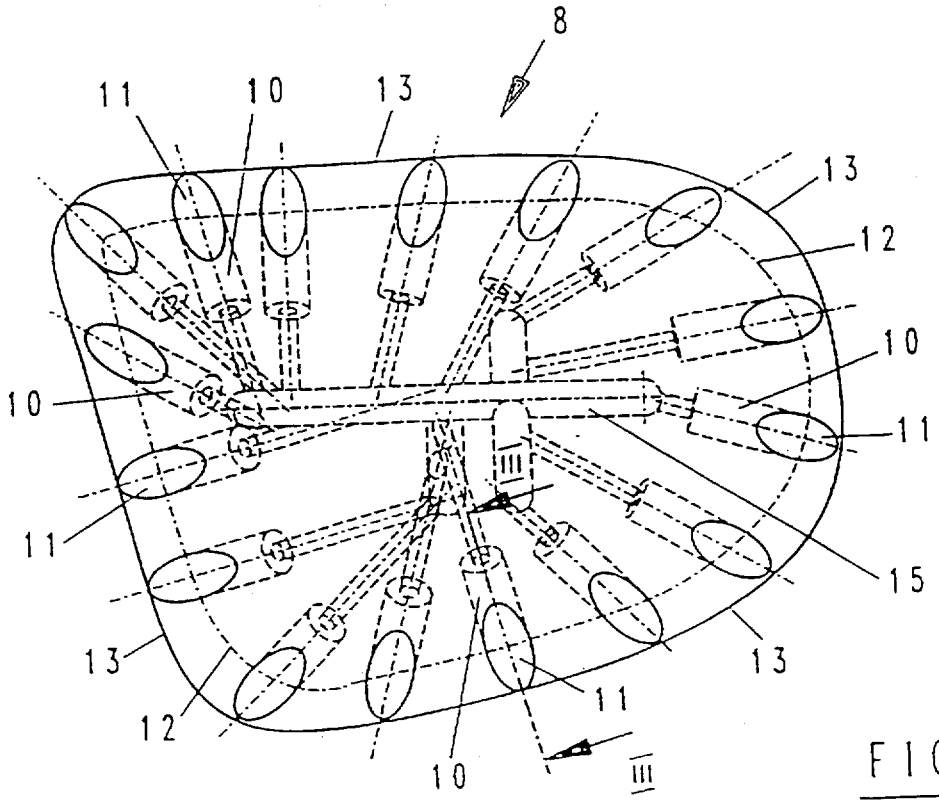
FIG. 2 is a top view of a contact surface of a carrier body.

The contact surface 8 of the carrier body 4 shown in FIG. 2 has outlet openings 11, whose central points are arranged on an imaginary line 12, which is at a constant distance from the boundary edge 13 of the contact surface 8. In FIG. 2, the outlet openings 11 have the shape of ellipses. The outlet openings 11 are the openings of cylindrical recesses 10, which are provided in the carrier body 4 and are formed by corresponding holes. The contact surfaces 8 may be curved as is apparent from FIG. 3.

An opening 14, which serves as a feed line 15 for a pressure medium, e.g., compressed air, opens into the recesses 10. The second contact surface 8' of this carrier body, which runs at an angle to the first contact surface 8, is likewise provided with recesses 10, which are also supplied with the pressure medium via a feed line 15. All feed lines 15 may be connected to a source of compressed air shared by all carrier bodies.

Figure 3:
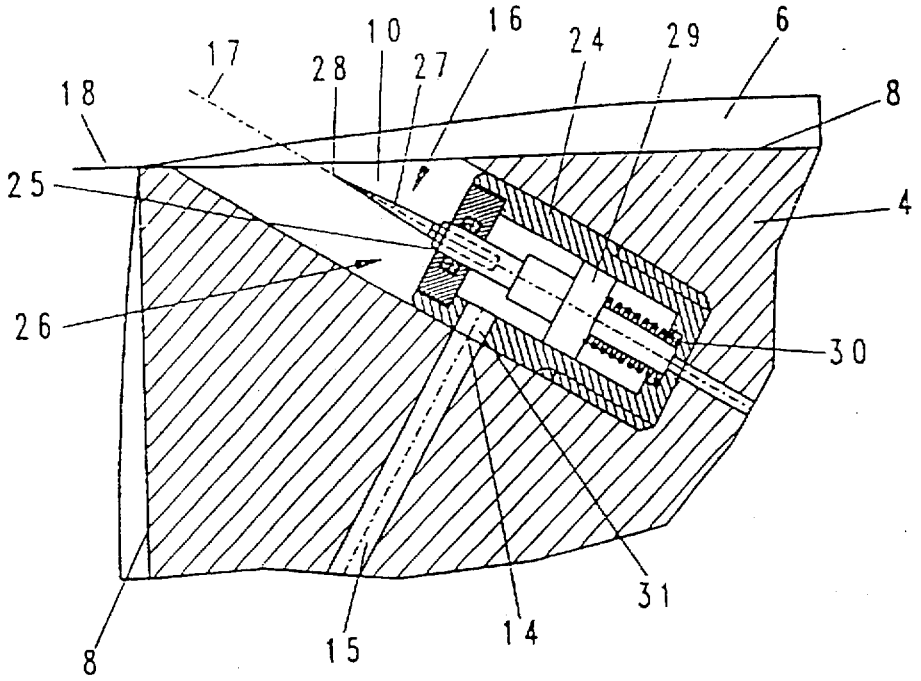
FIG. 3 is a section of the sectional view along the line III—III of FIG. 2.

A holding unit 16 is arranged in the recess 10, as shown in FIG. 3. The longitudinal axis of the holding unit 16, which coincides with the longitudinal axis 17 of the recess 10, forms an acute angle, amounting to approximately 30 degrees in the exemplary embodiment shown, with a tangent 18 to the contact surface 8. The holding unit 16 has a threaded sleeve 24, which is hermetically screwed into an internal thread of the recess 10. On its end facing the contact surface 8, the threaded sleeve 24 has an opening 25 for the passage of a holding element 26, which is formed by a needle 27 provided with a tip 28. The overall length of the needle 27 is shorter than the length of the opening 10, such that the tip 28 of the needle 27 is in its resting position within the carrier body. On the end of the needle 27 facing away from the tip 28, the needle is provided with a cylindrical extension 29, which is guided lengthwise within the recess 10. A spring element 30, which is designed as a compression spring and which controls the needle 27 towards the contact surface 8, is arranged between the area of the recess 10 and the outside of the extension 29.

The threaded sleeve 24, in its area situated between the front end of the opening 25 and the extension 29, has an opening 31, which is utilized for the passage of the pressure medium flowing out of the opening 14.

If the carrier body 4 is now to be fitted with blanks 6, the carrier body is moved to a feeding station. Then these blanks 6 are brought forward to the contact surfaces 8 by means of the feeding device 7 and held initially at the contact surfaces by the feeding device. The holding units 16 are acted upon with pressure medium via the shared pressure line 15, so that the tips 28 of the needles 27 are in their resting position within the recesses 10. The pressure line 15 is deaerated or unpressurized, so that, with the spring element 30 now being released, the needles 27 move out of the carrier body onto the blank and penetrate this blank completely or partially. Since the needles 27 are arranged uniformly distributed along the edge area of each of the contact surfaces 8, they exert, on the basis of their sloping position, a relatively low tension on each blank 6 in the now reached contact position, and they hold this blank on the respective contact surface 8 after the feeding device 7 returns to its initial position. The carrier body 4 can now be brought into the machining station or sewing position, which has since been taken by the carrier body 3, and the blanks 6 can be sewn together in any manner.

After the sewing operation, the carrier body 4 is again further rotated by a fractional pitch and is then in the removal position or station, in which the carrier body 5 was initially. The casing formed may now be removed from the carrier body 4. For this purpose, the pressure line 15 is acted upon, by means of which compressed air is likewise supplied to the holding units 16. The pressure overcoming the force of the spring element 30 moves the holding units 16 and thus the needles 27 with their tips 28 from their contact position situated outside the carrier body into the resting position situated within the carrier body, wherein they withdraw from the blank 6 and release this blank.

Figure 4:
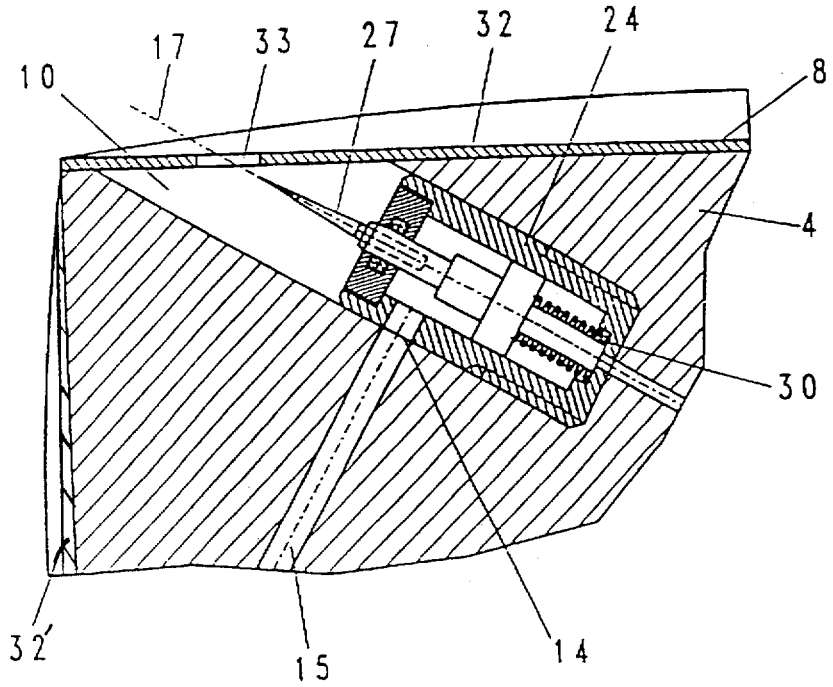
FIG. 4 is a view corresponding to FIG. 3 of a second embodiment of the present invention.

In the further embodiment of the present invention shown in FIG. 4, the carrier bodies 3, 4 and 5 each have, on their respective contact surfaces 8, 8' a stripper plate 32, 32' which is attached to the respective contact surfaces 8, 8'. Each of the stripper plates is provided with holes 33, whose center points are each on the longitudinal axis 17 of the recess 10. The diameter of the holes 33, which form the actual outlet openings 11 for the needles 27 in this case, are considerably smaller than the diameter 10 of the recess 10 and are adjusted to the needles 27, such that the needles 27 cannot draw the blank into the recess 10 during their movement from their contact position into the resting position. On the contrary, the blank is stripped from the needles during their return movement from the respective stripper plate 32, 32'.

While specific embodiments of the invention have been shown and described in detail to illustrate the application of the principles of the invention, it will be understood that the invention may be embodied otherwise without departing from such principles.

I claim:

1. A device for combining a plurality of flat workpieces into a three dimensional final shape, the device comprising:

a carrier body with a plurality of contact surfaces forming a shape substantially similar to the three dimensional final shape of the workpieces, each of said contact surfaces defining a plurality of recesses;

a plurality of holding means for holding each of the workpieces against one of said contact surfaces and in conformance with three dimensional final shape, each of said holding means being positioned in one of said recesses, said each holding means including a holding element movably positioned in a respective said recess, said holding element including a contact section for piercing the workpieces, said holding element being movable between a resting position where said holding element is positioned within said carrier body and a contact position where said contact section of said holding element is positioned outside said carrier body.

2. A device in accordance with claim 1, wherein:

said holding elements each have a longitudinal axis, and each said holding element is movable between said resting position and said contact position along a direction substantially parallel to a respective said longitudinal axis.

3. A device in accordance with claim 1, wherein:

said holding element is a needle and said contact section includes a tip insertable into the workpieces at an angle to hold the workpieces against the control surfaces.

4. A device in accordance with claim 1, wherein:

said holding elements each have a longitudinal axis, and each longitudinal axis forms an acute angle with a tangent to a respective said contact surface.

5. A device in accordance with claim 1, wherein:

said plurality of holding means are operable by a pressure medium.

6. A device in accordance with claim 5, wherein:

said plurality of holding means are connected to a shared pressure line.

7. A device in accordance with claim 1, wherein:

each of said plurality of holding means includes a spring element.

8. A device in accordance with claim 5, wherein:

pressure from said pressure medium forces said holding element into said resting position;

each of said plurality of holding means includes a spring element moving said holding element into said contact position in an absence of pressure from said pressure medium.

9. A device in accordance with claim 1, wherein:

said carrier body includes a stripper plate partially covering said recesses, said stripper plate defining a plurality of holes for passage of said contact sections.

10. A device in accordance with claim 1, wherein:

said contact surfaces include a boundary edge, said holding means holding the respective workpieces against the boundary edge;

a distance from said boundary edge of said contact surfaces to said holding element in said contact position is less than a distance from said edge to said holding element in said resting position.

11. A device in accordance with claim 1, wherein:

the workpieces are substantially two-dimensional objects and said contact surfaces extend in three dimensions, said holding means holds the workpiece in said three dimensions;

said contact section in said contact position is positioned on an opposite side of a respective said contact surface from said carrier body;

said contact section in said resting position is positioned on a side of said respective contact surface adjacent said carrier body;

said holding elements each have a longitudinal axis, and each longitudinal axis forms an acute angle with a tangent to a portion of a respective said contact surface adjacent a respective said recess, said acute angle having an opening in a direction toward an edge of said respective contact surface;

said holding means holds the workpieces at a position for machining of the workpieces;

said carrier body positions said contact surfaces at angles to one another;

the workpieces have a low bending strength.

12. A device in accordance with claim 1, wherein:

an arm mount includes a plurality of said carrier bodies, said arm mount being movable so that said plurality of carrier bodies move between a feeding station, a machining station and a removal station;

a feeding means places the workpieces against said contact surfaces at said feeding station;

said holding means has said holding elements in said resting position prior to the workpieces being placed against said contact surfaces, said holding means has said holding elements in said contact position after the workpieces are against said contact surfaces, said feeding means moving away from a carrier body at said feeding station after said holding means are in said contact position.

13. A device in accordance with claim 1, wherein:

said each of said contact surfaces with respective said holding means holds edges of the plurality of workpieces adjacent for joining, said holding means of a respective said contact surface being positioned inside of said edges of said workpiece.

14. A device in accordance with claim 1, wherein:

said each of said contact surfaces with respective said holding means holding edges of the plurality of workpieces adjacent for joining, said holding means of a respective said contact surface being positioned along a line spaced from said edge by a substantially constant distance.

15. A device in accordance with claim 1, wherein:

said each of said contact surfaces has a boundary edge, said holding means of said each contact surface holding a respective workpiece against a respective said boundary edge, said holding means of a respective said contact surface being positioned inside of said respective boundary edge.

16. A device in accordance with claim 1, wherein:

said each of said contact surfaces has a boundary edge, said holding means of said each contact surface holding a respective workpiece against a respective said boundary edge, said holding means of a respective said contact surface being positioned along a line spaced from said boundary edge by a substantially constant distance.

* * * * *